US009321284B2

(12) United States Patent
Sugimoto et al.

(10) Patent No.: US 9,321,284 B2
(45) Date of Patent: Apr. 26, 2016

(54) PRINTER, CONTROL DEVICE, PROGRAM AND RECORDING MEDIUM

(75) Inventors: Yoshirou Sugimoto, Tomi (JP); Akihiro Onodera, Hachioji (JP)

(73) Assignee: MIMAKI ENGINEERING CO., LTD., Tomi, Nagano (JP)

( * ) Notice: Subject to any disclaimer, the term of this patent is extended or adjusted under 35 U.S.C. 154(b) by 45 days.

(21) Appl. No.: 13/880,376

(22) PCT Filed: Oct. 19, 2011

(86) PCT No.: PCT/JP2011/074018

§ 371 (c)(1), (2), (4) Date: Jul. 1, 2013

(87) PCT Pub. No.: WO2012/053539

PCT Pub. Date: Apr. 26, 2012

(65) Prior Publication Data

US 2013/0278663 A1 Oct. 24, 2013

(30) Foreign Application Priority Data

Oct. 19, 2010 (JP) ..... 2010-234954

(51) Int. Cl.
*B41J 29/38* (2006.01)
*B41J 29/387* (2006.01)
(Continued)

(52) U.S. Cl.
CPC ..... *B41J 11/008* (2013.01); *B41J 19/205* (2013.01)

(58) Field of Classification Search
CPC ..... B41J 11/00; B41J 11/08; B41J 29/38; B41J 29/393; B41J 11/002; B41J 25/304; B41J 25/308; B41J 29/387; B41J 2029/38
USPC ..... 347/14
See application file for complete search history.

(56) References Cited

U.S. PATENT DOCUMENTS 3,973,662 A * 8/1976 Fulton ..... H04L 21/04 178/30
4,600,319 A * 7/1986 Everett, Jr. ..... B41J 29/38 400/52

(Continued)

FOREIGN PATENT DOCUMENTS

CN 1104583 A 7/1995
JP 04-129781 A 4/1992

(Continued)

OTHER PUBLICATIONS

Keck, AO Software Design Book, Chapter 7.9, 1997.*

(Continued)

*Primary Examiner* — Geoffrey Mruk
*Assistant Examiner* — Scott A Richmond
(74) *Attorney, Agent, or Firm* — Park, Kim & Suh, LLC

(57) ABSTRACT

A printer that restarts printing from a desired print position after an emergency stop is provided. A printer according to the present disclosure includes a head printing on a work, a driving motor moving at least one of the head and the work in order to change a print position on the work, a rotary encoder and an encoder counter determining a position of the head relative to the work, a control device supplying electric power to the encoder after excitation of the driving motor is turned off during printing and enabling the encoder counter to continue counting.

15 Claims, 9 Drawing Sheets

(51) Int. Cl.
*B41J 11/00* (2006.01)
*B41J 19/20* (2006.01)

(56) References Cited

U.S. PATENT DOCUMENTS

| | | | | |
|---|---|---|---|---|
| 6,015,202 | A | 1/2000 | Hiramatsu et al. | |
| 6,874,962 | B2 | 4/2005 | Shibata et al. | |
| 6,877,837 | B1 * | 4/2005 | Igarashi | B41J 9/202 318/616 |
| 2001/0002134 | A1 * | 5/2001 | Minowa | B41J 2/1652 347/35 |
| 2002/0075340 | A1 * | 6/2002 | Moriyama | B41J 2/17566 347/14 |
| 2004/0085376 | A1 * | 5/2004 | Takada | B41J 2/04528 347/17 |
| 2004/0246293 | A1 * | 12/2004 | Sanpei | B41J 2/14274 347/22 |
| 2008/0238995 | A1 * | 10/2008 | Menendez | B41J 3/28 347/37 |
| 2009/0115827 | A1 * | 5/2009 | Endo | B41J 11/0015 347/102 |
| 2010/0177333 | A1 * | 7/2010 | Nakagaki | 358/1.12 |
| 2011/0074856 | A1 * | 3/2011 | Iesaki | B41J 11/006 347/16 |

FOREIGN PATENT DOCUMENTS

| | | | |
|---|---|---|---|
| JP | 05-338308 | A | 12/1993 |
| JP | 06-106819 | A | 4/1994 |
| JP | 07-215542 | A | 8/1995 |
| JP | 07-329937 | A | 12/1995 |
| JP | 11-138947 | A | 5/1999 |
| JP | 2001-347650 | A | 12/2001 |
| JP | 2005-153258 | A | 6/2005 |
| JP | 2010-111057 | A | 5/2010 |

OTHER PUBLICATIONS

International Search Report in International Application No. PCT/JP2011/074018, dated Nov. 22, 2011.

Korean Office Action in Appln. No. 10-2013-7009784 dated Oct. 1, 2014.

Chinese Office Action in Appln. No. 201180059426.9 dated Sep. 2, 2014.

Chinese Office Action in Appln. No. 201180059426.9 dated Apr. 20, 2015.

* cited by examiner

PRINTER, CONTROL DEVICE, PROGRAM AND RECORDING MEDIUM

CROSS-REFERENCE TO RELATED APPLICATIONS

This application is the National Stage filing under 35 U.S.C. 371 of International Application No. PCT/JP2011/074018, filed on Oct. 19, 2011, which claims the benefit of Japanese Patent Application No. 2010-234954, filed on Oct. 19, 2010, the contents of which are all hereby incorporated by reference herein in their entirety.

TECHNICAL FIELD

The present disclosure relates to a printer, a control device, a program and a recording medium, and more particularly, to an inkjet printer including a recording head, a control device controlling the recording head, a program, and a recording medium.

BACKGROUND ART

The conventional inkjet printers restart printing from a position at a time when printing is stopped. (refer to patent documents 1 and 2)

For example, the patent document 1 discloses a printer that, when an ink cartridge needs to be replaced during printing, temporarily stops and restarts printing from a position where the printing is stopped after a new ink cartridge is installed. Also, the patent document 2 discloses a printer that, when a drive roller is stopped during printing, prevents a packaging sheet from being loosened and restarts printing from a position where the drive roller is stopped.

PRIOR ART DOCUMENTS

Patent Documents

Patent Document 1: Japanese Patent Publication No. 2001-347650 (published on Dec. 18, 2001)

Patent Document 2: Japanese Patent Publication No. H07-329937 (published on Dec. 19, 1995).

DISCLOSURE OF INVENTION

Technical Problem

When the printers described above are temporarily stopped, they restart printing from a position where printing is stopped. In order to avoid a boundary line created by restarting, after a temporary stop command is generated, printing on a recording medium is continued to an ideal position to stop printing and is stopped. Also, in order to restart printing properly, a printing head and nozzle head are continuously controlled. Thus, once printing is stopped, even when the printing head or nozzle head move to a different position, they can be returned to a print stop position from the different position.

However, large size printers such as large size inkjet printers include a system that immediately stops the printers for safety of user and device. For example, when an opening of an inkjet printer cover is detected or a user presses an emergency stop button, excitation currents of a driving motor are cut off to immediately stop printing.

Conventional printers for emergency stop, unlike temporary stop, do not restart printing from a position where printing is stopped. Thus, printing on a recording medium is not continued to an ideal position to stop printing. In other words, when an emergency stop button is pressed for an emergency stop, the excitation currents of the driving motor are cut off to immediately stop printing. Thus, a work has to be reprinted from the beginning if printing is stopped for emergency. Therefore, the portion that has been printed already is wasted and it takes time to reset the work.

The conventional printers do not restart printing from a position where the printing is stopped for emergency. Even if they are set to restart from a position where the printing is stopped for emergency, a lower quality of printing is resulted when an emergency stop occurs because restarting printing from a position where the printing is stopped makes a visible boundary line.

Thus, the purpose of the present disclosure is to provide a printer that provides high quality of printing products when printing is restarted and that restarts printing from a desired position, even if printing is suddenly stopped.

Technical Solution

According to an embodiment of the present disclosure, an inkjet recording apparatus includes a recording head recording on a recording medium, a driving motor moving at least one of the recording head and the recording medium in order to change a recording position on the recording medium, position determining means for determining a position of the recording head relative to the recording medium, and controlling means for controlling the position determining means such that the relative position of the recording head is continuously determined by the position determining means after an emergency stop command is generated during recordation to turn off excitation of the driving motor.

According to the embodiment, since the driving motor moves at least one of the recording head and the recording medium, recording by changing a recording position on the recording medium is possible. The recording position of the recording head can be controlled by determining a position of the recording head relative to the recording medium. Here, even if an emergency stop command to turn off the excitation of the driving motor is generated while recording on the recording medium by the recording head, the position determining means is controlled such that the relative position of the recording head is continuously determined. For that reason, although the excitation of the driving motor is turned off, the position determining means can continuously determine the relative position of the recording head. Thus, although the recording head moves due to inertia after the excitation of the driving motor is turned off or a user physically moves the recording head, the position determining means can continuously determine the relative position of the recording head. Therefore, when a restart command is generated, the recording head can move to a desired position for recording because a relative position of the recording head at a time when the restart command is generated can be determined. When recording is urgently stopped by turning off the excitation of the driving motor, recording can be continuously performed on the recording medium by using recording information obtained up to date.

For conventional recording apparatuses, power is not supplied to detectors such as an encoder coupled with a driving motor when the excitation of the driving motor moving a recording head or recording medium is turned off during recording. When the recording head is moved after the excitation of the driving motor is turned off, the rotor position is not detected because the encoder does not function. Therefore, it is impossible to determine the position of the recording head from the rotor position. Even if the encoder functions, the rotor position cannot be determined because a counter counting a signal from the encoder does not function. Therefore, the recording head cannot be moved to a desired position to restart printing because a starting position (actual position) of the recording head is not determined. For this reason, the printing must be restarted from the beginning and the recording head must be returned to an initial position. As a result, the recorded work becomes useless and it takes time to reset the work.

However, in the inkjet recording apparatus according to the embodiment of the present disclosure, the recording head can be moved to a desired position and restart recording from the desired position because a starting position from which the recording head should move to the desired position is determined. Printing cost and time can be reduced because unnecessary waste of recording and recording medium and additional resetting time are eliminated.

Meanwhile, it is preferred that the position determining means included in the inkjet recording apparatus according to the embodiment of the present disclosure includes a rotary encoder detecting a rotor position of the driving motor, and an encoder counter counting a signal output from the rotary encoder.

Generally, a rotary encoder coupled with a driving motor is used for detecting a position of a recording head. Thus, as the rotary encoder moves, the position of the recording head relative to the recording medium can be easily determined without using an additional detecting device.

Also, the controlling means supplies electric power to the rotary encoder and enables the encoder counter to continue counting the signal output from the rotary encoder after the emergency stop command is generated such that the relative position of the recording head is continuously determined by the position determining means.

Although an emergency stop command to turn off the excitation of the driving motor is generated, the rotary encoder continuously detects the rotor position of the driving motor and the encoder counter can continuously count the signal output from the rotary encoder. Therefore, after the emergency stop command is generated to turn off the excitation of the driving motor, the relative position of the recording head can be determined.

The inkjet recording apparatus according to the embodiment preferably further includes position extracting means for extracting from the position determining means a position of the recording head relative to the recording medium at a time when a restart command is generated after the emergency stop command is generated.

According to the embodiment, the relative position at a time when the restart command is generated can be automatically identified.

The inkjet recording apparatus according to the embodiment preferably further includes motor control means for controlling the driving motor to move the recording head from the relative position extracted by the position extracting means to a restart position.

According to the embodiment, the recording head can be automatically moved from a stop position to a restart position.

According to the embodiment, the position extracting means preferably further extracts from the position determining means a position of the recording head relative to the recording medium at a time when the emergency stop command is generated.

According to the embodiment, because the position of the recording head relative to the recording medium can be determined after the emergency stop command to turn off the excitation of the driving motor is generated, a restart position can be determined based on the relative position at the time when the emergency stop command is generated.

An inkjet recording apparatus according to another embodiment of the present disclosure includes a recording head recording on a recording medium, a first driving motor moving the recording head in a scanning direction, and a second driving motor moving the recording head or indirectly moving the recording medium in a vertical scanning direction which is perpendicular to the scanning direction and is parallel to a recording side (surface). The apparatus further includes first position determining means for determining a position of the recording head relative to the recording medium in the scanning direction, second position determining means for determining a position of the recording head relative to the recording medium in the vertical scanning direction, and controlling means for controlling the first and second position determining means such that the relative positions of the recording head are continuously determined by the first and second position determining means, respectively, after an emergency stop command is generated during recordation to turn off excitation of the first and second driving motors.

The present disclosure can be applied to inkjet recording apparatuses recording on a recording medium in two directions being perpendicular to each other.

According to the embodiment, it is preferred that the second driving motor moves the recording head indirectly.

The present disclosure can be applied to inkjet recording apparatuses recording on a recording medium by fixing the recording medium and moving a recording head in two directions being perpendicular to each other.

Also, the inkjet recording apparatus according to the embodiments further includes protecting means for protecting the recording head during the recordation, and detecting means for detecting opening or closing of the protecting means during the recordation. The detecting means generates the emergency stop command when the opening of the protecting means is detected.

According to the embodiments, recording can be restarted even if the recording is suddenly stopped by opening the protecting means.

Also, the inkjet recording apparatus according to the embodiments preferably further includes ink curing means for curing Ultraviolet (UV) ink ejected by the recording head on the recording medium.

According to the embodiments, UV ink can be cured after being discharged. UV ink can be cured even if the operation of the inkjet recording apparatus is stopped for emergency stop. As a result, smearing can be avoided. Higher quality recording can be realized because a boundary line created by restarting the recording can be invisible.

A control device according to an embodiment of the present disclosure for controlling an inkjet recording apparatus including a recording head recording on a recording medium, a driving motor moving at least one of the recording head and the recoding medium to change a recording position on the recording medium, and position determining means for determining a position of the recording head relative to the recording medium, includes controlling means for controlling the position determining means such that the relative position is continuously determined by the position determining means after an emergency stop command is generated during recordation to turn off excitation of the driving motor.

The present disclosure can be applied to inkjet recording apparatuses having a recording head recording on a recording medium, a driving motor moving at least one of the recording head and the recording medium in order to change a recording position on the recording medium and position determining means for determining a position of the recording head relative to the recording medium, where an emergency command to turn off the excitation of the driving motor is generated.

Also, a program for enabling a computer to function as the controlling means and a computer-readable recording medium recording the program are within the scope of the present disclosure.

Advantageous Effects

A printer according to the present disclosure includes control means for controlling position determining means such that a position of a recording head relative to a recording medium is continuously determined after an emergency stop command to turn off excitation of a driving motor is generated during recordation.

For that reason, the position of the recording head can be determined and printing can be started from a desired position after the excitation of the driving motor is suddenly turned off.

Also, a control device according to the present disclosure includes control means for controlling position determining means such that a position of a recording head relative to a recording medium is continuously determined after an emergency stop command to turn off excitation of a driving motor during recordation.

For that reason, the position of the recording head can be determined and printing can be started from a desired position after the excitation of the driving motor is suddenly turned off.

BRIEF DESCRIPTION OF THE DRAWINGS

FIG. 7(A) shows that the head is stopped for the emergency stop.

FIGS. 8(A) and (B) illustrate a work and a head according to another embodiment of the present disclosure when an emergency stop occurs, FIG. 8(A) shows that the head is stopped after the emergency stop and FIG. 8(B) shows that the head is moved to a restart position for printing;

BEST MODE FOR CARRYING OUT THE INVENTION

Embodiment 1

Reference will now be made in detail to an embodiment of the disclosure, examples of which are illustrated in FIGS. 1, 2, 3, 4, 5(A) to 5(C), 6(A) to 6(D), 7(A) to 7(C), and 9.

[Configuration of Printer]

Figure 1:
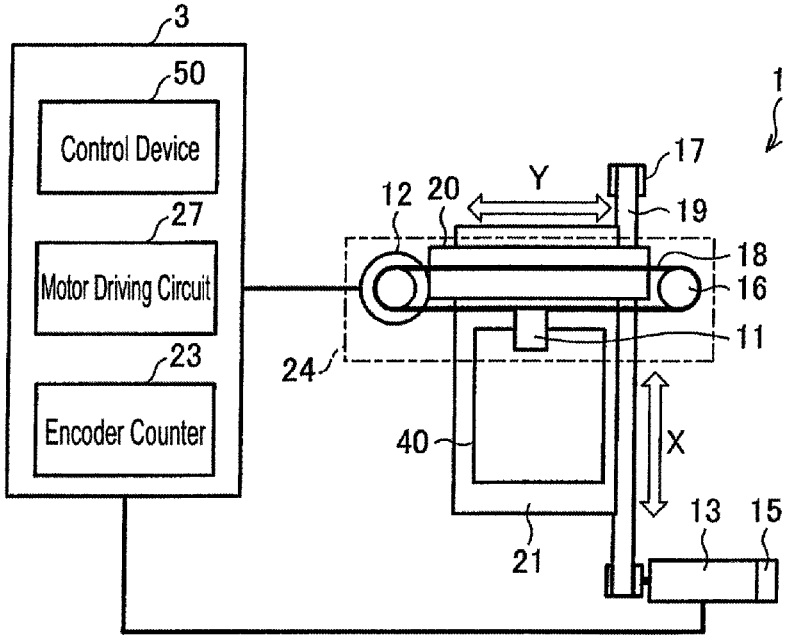
FIG. 1 illustrates a printer according to the present disclosure.
Figure 2:
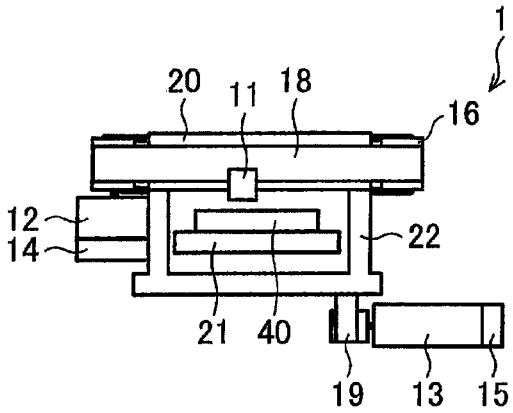
FIG. 2 illustrates the printer shown in FIG. 1 from a different view.

First, a printer 1 (inkjet recording apparatus) according to an embodiment of the present disclosure will be described with reference to FIG. 1 and FIG. 2. FIG. 1 and FIG. 2 illustrate the printer according to the embodiment. FIG. 1 illustrates a top view of a portion of the printer other than a servo system. FIG. 2 illustrates a front view of the portion of the printer shown in FIG. 1.

As shown in FIG. 1, the printer includes a head 11 (recording head) printing on a work (media, recording medium), a Y motor 12 (driving motor, first driving motor) moving the head 11 in a scanning direction (Y direction shown in FIG. 1, hereinafter, "Y direction"), a manual pulley 16 and a timing belt 18 delivering the motion of the Y motor 12 to the head 11, a Y bar 20 guiding the motion of the head 11 in the Y direction, an X motor 13 (driving motor, second driving motor) moving the head 11 indirectly through the Y bar 20 in a vertical scanning direction (X direction shown in FIG. 1, hereinafter, "X direction") perpendicular to the scanning direction, an encoder 15 (position determining means, second position determining means) coupled with the X motor 13, a manual pulley 17 and a timing belt 19 delivering the motion of the X motor 13 to the Y bar 20, a printing table 21, and a servo system 3 controlling the motions of the Y motor 12 and the X motor 13.

Also, as shown in FIG. 2, the printer 1 further includes an encoder 14 (position determining means, first position determining means) coupled with the Y motor 12, and a Y bar supporting member 22 surrounding the print table 21 and supporting the Y bar 20. The Y bar 20 is moved by the X motor 13 through the Y bar supporting member 22. A position (relative position) of the head 11 relative to the work 40 and printing position (recording position) are changed by the driving of the Y motor 12 and the X motor 13. Moreover, an optical linear encoder is coupled with the Y bar 20 for determining a time for ejecting ultraviolet (UV) ink from an ink nozzle mounted on the head 11 by determining the head 11 position.

The printer 1 according to the embodiment is an UV inkjet printer. For that reason, light-emitting diode (LED) (ink curing means) is mounted in the proximity to the back of a nozzle (not illustrated) discharging UV ink in the scanning direction of the head 11. The LED cures the discharged UV ink by irradiating UV. Thus, the ink can be cured immediately after being dropped on a media. Means for curing UV ink is not limited to LED but can include any optical source emitting ultraviolet light such as a metal halide and a xenon lamp.

FIG. 1 and FIG. 2 show that the work 40 is placed on the printing table 21. The printer 1 includes an openable cover 24 (protecting means) that covers the Y motor 12, the Y bar 20, and the head 11 for protection. The cover 24 is illustrated in dotted lines in FIG. 1 and is not illustrated in FIG. 2.

The printer 1 according to the embodiment is a flatbed printer that prints on the flat work 40 on the printing table 21. Also, the entire work 40 is printed by not moving the printing table 21 and work 40 but moving the head 11 in the X and Y directions. Additionally, the head 11 of the flatbed printer can move only in the Y direction and the printing table and work can move only in the X direction. Or, the present disclosure can be applied to a grid rolling printer that prints on a portion of work that is rolled down. Also, a method of printing images by single scan in the Y direction or by single scan in the X direction is possible as long as the head 11 can move to a position relative to the work in any direction.

The servo system 3 includes a motor driving circuit 27 (motor controlling means, controlling means) driving the Y motor 12 and the X motor 13, a control device 50 controlling the operation of the Y motor 12 and the X motor 13 by controlling the motor driving circuit 27, and an encoder counter 23 (a position determining means, first position determining means) receiving and counting pulse signals outputted from the encoders 14 and 15.

On the other hand, the position determining means (the first position determining means) according to the embodiment also includes the encoder 14 coupled with the Y motor 12. As illustrated, because the optical linear encoder is coupled with the Y bar 20 for determining the time for discharging UV ink from the ink nozzle mounted on the head 11 by determining the position of the head 11, the position determining means may include the optical linear encoder instead of the encoder 14.

The Y motor 12 can be controlled by the servo system 3. The driving force of the Y motor 12 is delivered to the head 11 through the manual pulley 16 and the timing belt 18. The head 11 moves in the Y direction as the Y motor 12 rotates. The direction and the speed that the head 11 moves are determined by the rotating direction and the speed of the Y motor 12. The rotation direction, the number of rotations, and the rotation speed are controlled by excitation currents supplied to the Y motor 12.

The operation of the X motor 13 is also controlled by the servo system 3. The driving force of the X motor 13 is delivered to the Y bar supporting member 22 through the manual pulley 17 and the timing belt 19. The head 11 moves in the X direction through the Y bar 20 as the Y bar supporting member 22 moves. The direction and the speed that the head 11 moves are determined by the rotating direction and speed of the X motor 13. The rotation direction, the number of rotations and rotation speed are controlled by excitation currents supplied to the X motor 13.

The encoder 14 is a rotary encoder and outputs a pulse signal to the encoder counter 23 by detecting the rotor position of the Y motor 12. The encoder 15 is a rotary encoder and outputs a pulse signal to the encoder counter 23 by detecting the rotor position of the X motor 13.

The encoders 14 and 15 are supplied with power by the servo system 3 after the excitations of the Y motor 12 and the X motor 13 are turned off. For that reason, after the excitations of the Y motor 12 and the X motor 13 are turned off during printing, the rotor positions of the Y motor 12 and the X motor 13 are continuously detected. The encoder counter 23 is controlled such that it continuously counts a pulse signal from each encoder after the excitations are turned off.

Figure 9:
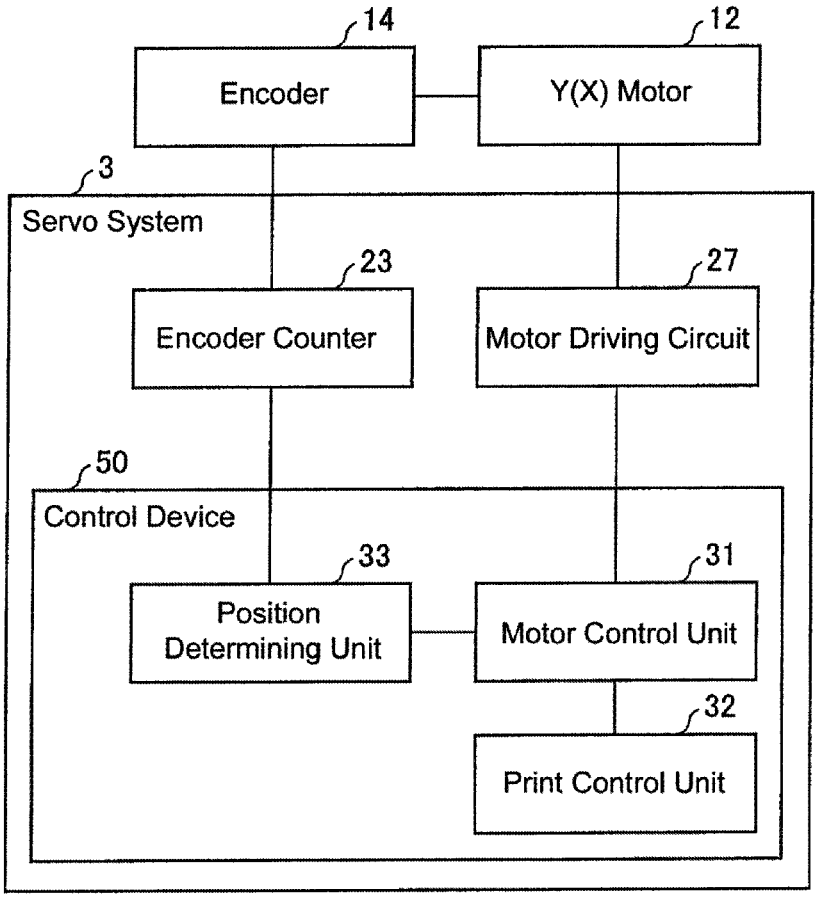
FIG. 9 illustrates a block diagram of a servo system and a control device according to the present disclosure.

FIG. 9 illustrates a block diagram of the servo system 3. As illustrated in FIG. 9, the servo system 3 includes the encoder counter 23, the motor driving circuit 27, and the control device 50. Moreover, the control device 50 includes a motor controlling unit 31 (motor controlling means, position determining means), a print controlling unit 32 (print controlling means), and a position determining unit 33 (position determining means, position extracting means). The motor controlling unit 31 sends various commands to control the operation of the Y motor 12 and the X motor 13 to the motor driving circuit 27. According to these commands, the motor driving circuit 27 supplies currents and power to operate the Y motor 12, the X motor 13, and the encoders. The print controlling unit 32 is a module that controls printing by the head 11 and corresponds the printing to the operation of the Y motor 12. The position determining unit 33 receives encoder count values of the pulse signals of the encoders 14 and 15 from the encoder counter 23. Based on the received count values, each rotor position of the Y motor 12 and the X motor 13 is detected, and the position of the head 11 is determined. The determined position information of the head 11 is transmitted to the motor controlling unit 31. The motor controlling unit 31 can set operation conditions of each motor by using the position information transmitted from the position determining unit 33.

[Operation of Printer]

The operation of the printer 1 including an emergency stop of printing and a restart due to opening and closing of the cover will be now described with reference to FIGS. 3, 4, 5, and 6. The brief operation of the printer 1 is now explained with reference to FIG. 3 before explaining the detailed operation of the printer 1.

Figure 10:
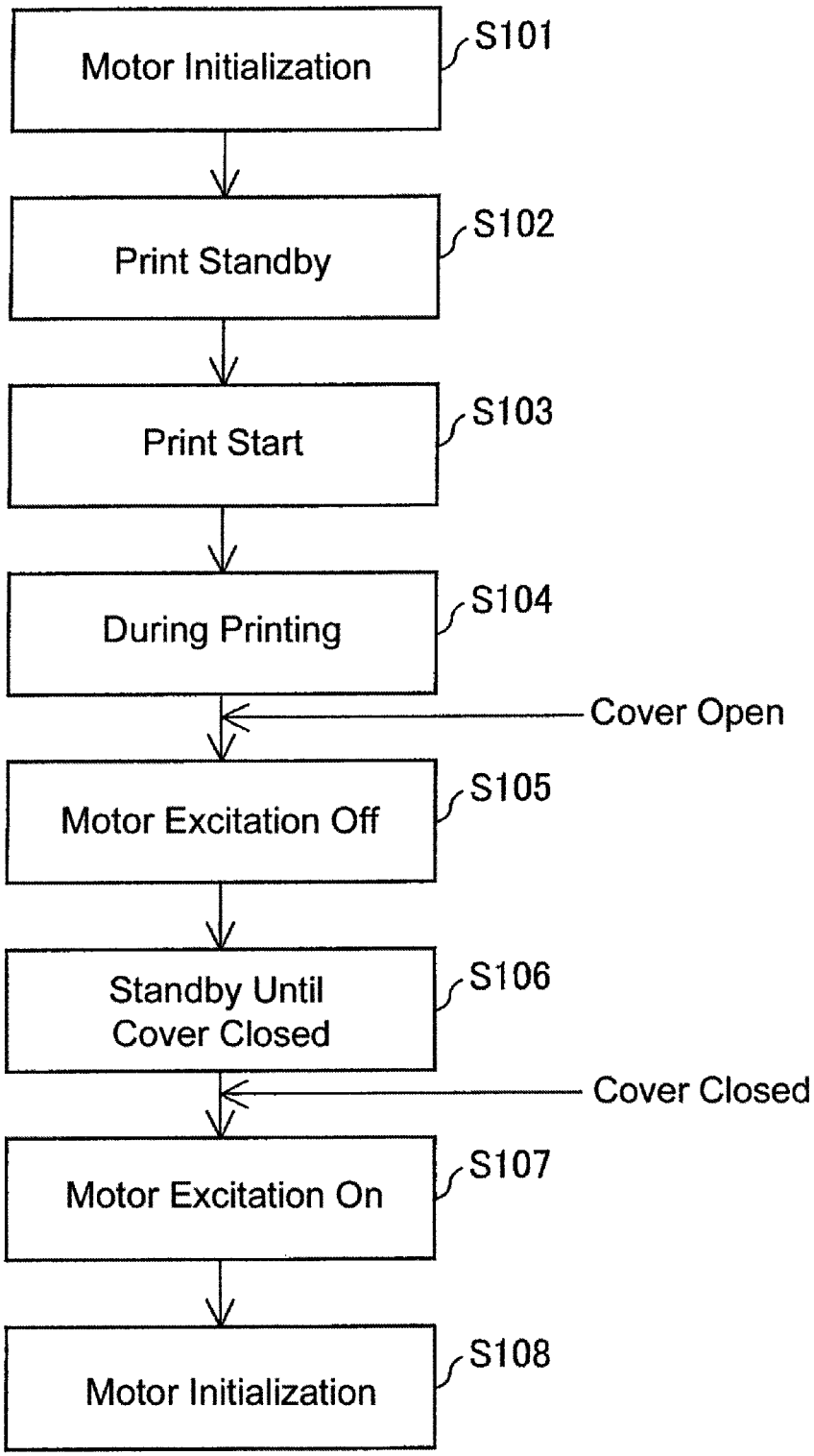
FIG. 10 illustrates a flow chart showing operation of a conventional printer for an emergency stop.

Prior to printing, the motors 12 and 13 in the printer 1 are initialized (S1). After the initialization, the printer 1 is set to a standby (print ready) mode until a command to print is received (S2), and the printer starts printing when the command to print is received (S3). When the cover 24 is opened during printing (S4), excitations of the motors 12 and 13 are turned off by detecting that the cover is opened (emergency stop command) (S5). The printer 1 is in the standby mode until the cover is closed (S6). Power is continuously supplied to the encoder even when the excitations of the motors are turned off, and the encoder continuously detects the rotor positions of the motors. When it is detected that the cover 24 is closed, the excitations of the motors are turned on (restart command) (S7). When the excitations of the motors are turned on, the count values of the encoder are read and the position of the head 11 stopped is determined. Then, the restart position is determined, and a corresponding rotor position is set (S8). When the rotor position for the restart is set, the head 11 moves from a current position to the determined restart position by moving the motor to the set rotor position (S9). When the head 11 reaches the determined restart position, printing is restarted (S10) and is terminated (S11). A Meanwhile, in the conventional printer, the excitation of the motor is turned off (S103) if the cover is opened during printing (S104) after initializing the motor (S101), setting the printer to a standby mode (S102), and starting printing after the command to print is received (S103), as shown in FIG. 10. Until the cover is closed, the printer stays in the standby mode (S106). If it is detected that the cover is closed, the excitation of the motor is turned on (S107). When the excitation of the motor is turned on, the motor is initialized (S108). Because the motor is initialized when the excitation is turned on, printing will have to start from the beginning.

Figure 3:
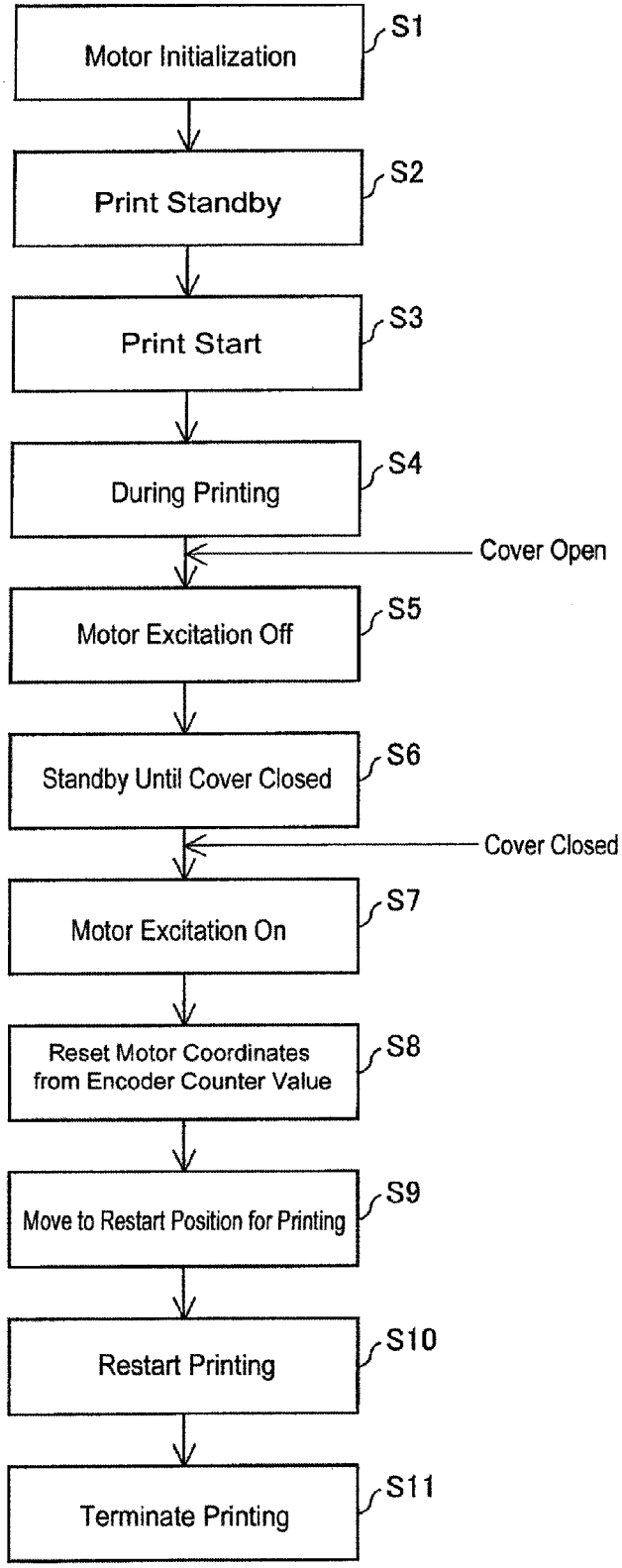
FIG. 3 illustrates a flow chart showing operation of the printer for an emergency stop during printing.
Figure 4:
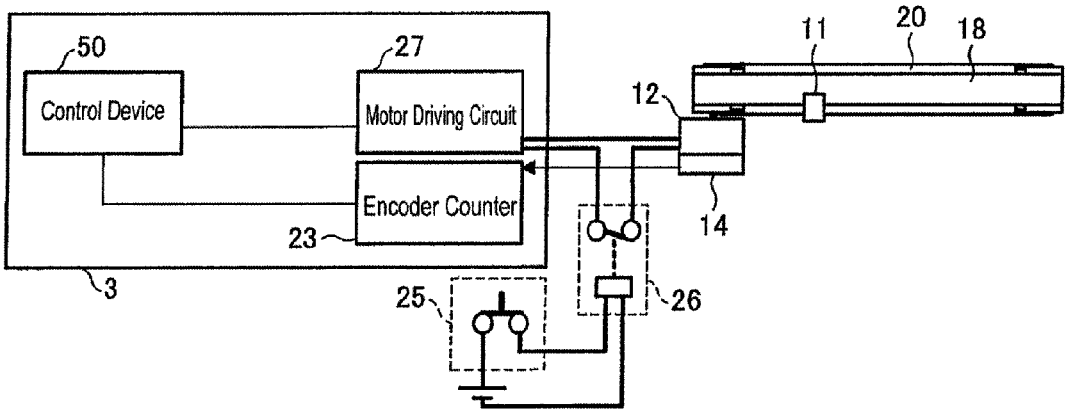
FIG. 4 illustrates a switch and a relay that control motor excitation when opening or closing of a cover occurs and illustrates a system and the printer.
Figure 5:
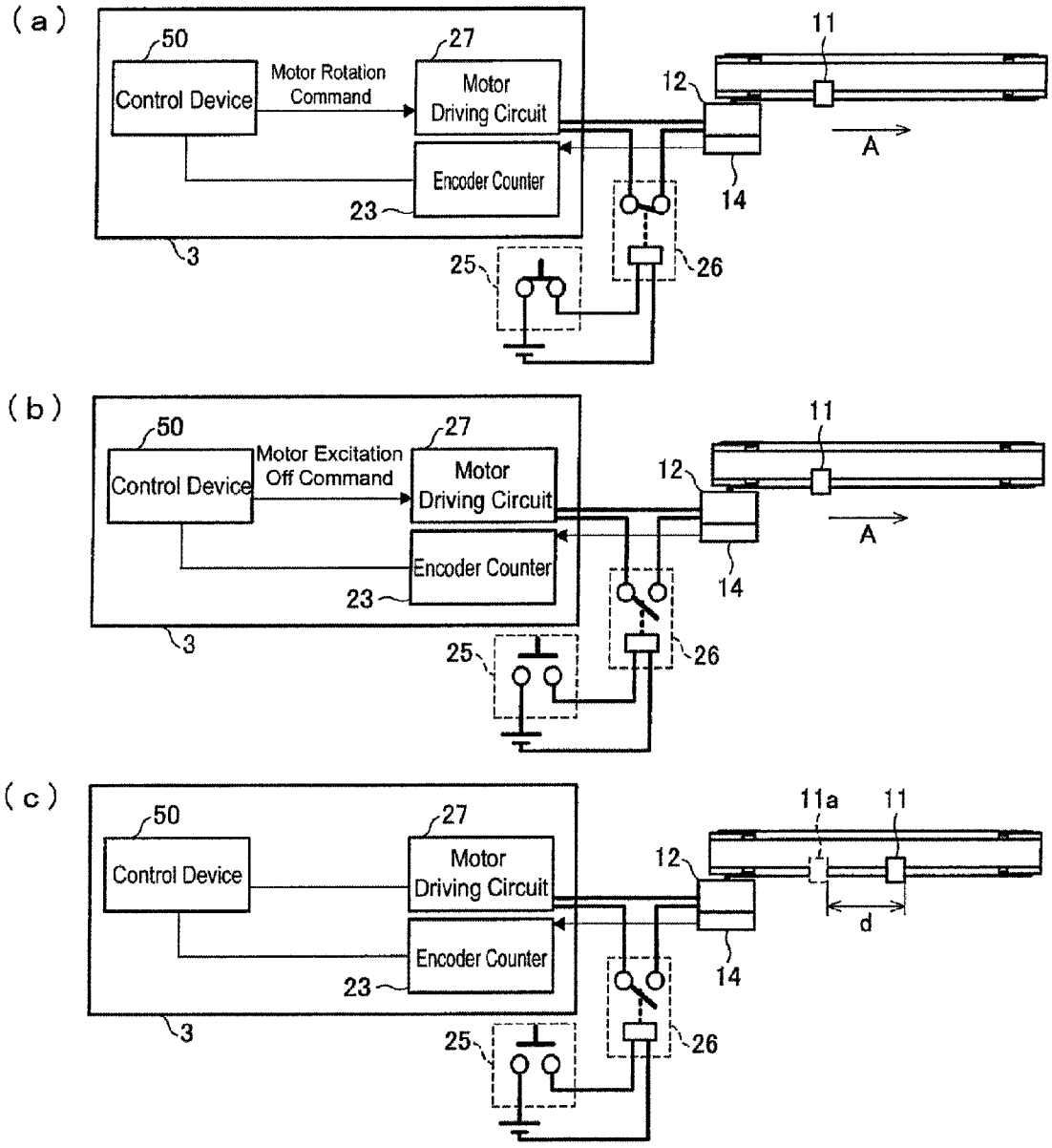
FIGS. 5(A), (B), and (C) illustrate the switch, relay, printer when the cover is opened during printing.
Figure 6:
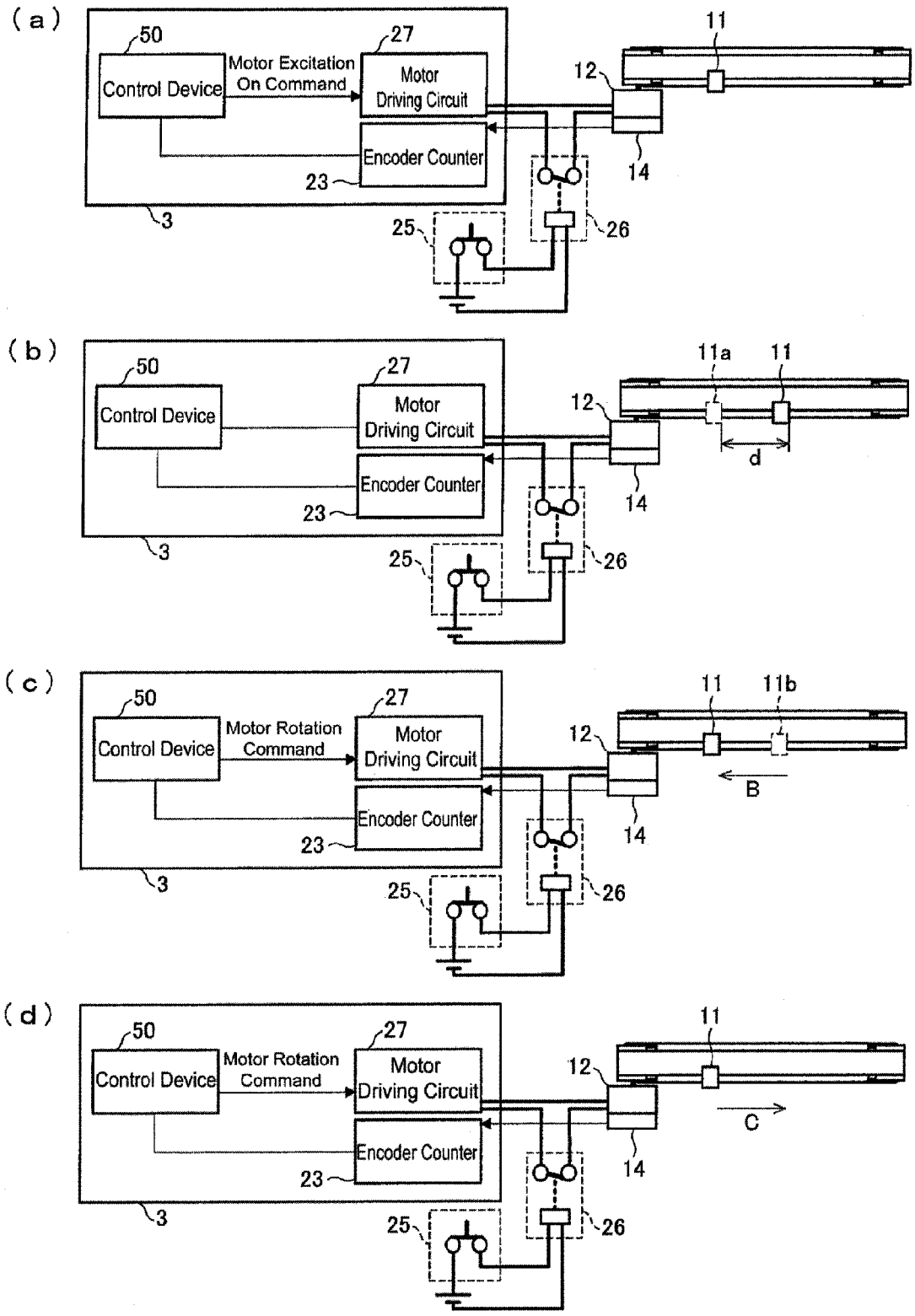
FIGS. 6(A), (B), (C), and (D) illustrate the switch, relay, and printer when the cover is closed after the cover is opened as shown in FIGS. 5(A), (B), and (C)

Referring to FIGS. 4, 5, and 6, the operation of the printer 1 for an emergency stop caused by the opened cover will now be described. In FIGS. 3, 4, and 5, the operation control of the Y motor 12, the detection of the rotor position by the encoder 14, and the motion of the head 11 in the Y direction are shown. The operation control of the X motor 13, the detection of the rotor position by the encoder 15, and the motion of the head 11 in the X direction (motion of the Y bar 20) are omitted as the description of these is the same as that of those for the Y direction.

FIG. 4 illustrates a portion of the printer 1. As shown in FIG. 4, besides the portion of the printer 1 described above, the printer 1 further includes a switch 25 (detecting means) which is turned on or off depending on whether the cover is closed or opened, and the relay 26 controlling to supply excitation currents to the Y motor 12 according to a switch control signal received from the switch 25.

In FIG. 4, the switch 25 is turned on when the cover 24 is closed. As a result, excitation current is supplied to the Y motor from the motor driving circuit 27 through the relay 26.

FIGS. 5(A), (B), and (C) illustrate that the head 11 is stopped due to the emergency stop caused by opening the cover 24 during printing. Meanwhile, FIGS. 6(A), (B), (C), and (D) illustrate that the excitation of the motor is turned on by closing the cover 24 after the excitation of the motor is turned off and printing is restarted.

FIG. 5(A) illustrates that the motor driving circuit 27 supplies current to the Y motor 12 to rotate the Y motor 12 while excitation current is supplied to the Y motor 12 through the relay 26 with the cover 24 of the printer 1 closed. Current is supplied from the motor driving circuit 27 such that the Y motor 12 can move in A direction as shown in FIG. 5(A). Power is supplied from the motor driving circuit 27 to the encoder 14. The encoder 14 continuously detects the rotor position of the Y motor 12 and outputs a detected pulse signal to the encoder counter 23.

FIG. 5(B) illustrates that the cover 24 of the printer shown in FIG. 5(A) is opened. When the cover 24 is opened during printing, the switch 25 is turned off by detecting that the cover 24 is opened. The off signal is received by the relay 26 and the relay 26 is turned off. Then, the motor controlling unit 31 of the control device 50 sends a command to turn off the excitation current to the motor driving circuit 27. After the excitation of the Y motor 12 is turned off, the Y motor 12 continues to rotate for a short moment due to inertia. As a result, the head 11 continues to move in the A direction. However, at the same time, the encoder 14 is continuously supplied with power. For that reason, the encoder 14 continues to detect the rotor position of the Y motor 12 and outputs the detected pulse signal to the encoder counter 23.

FIG. 5(C) illustrates that the head 11 is stopped after the excitation of the Y motor 12 is turned off by opening the cover 24. As shown in FIG. 5(C), the distance between the position of the head 11 at a time when the excitation of the Y motor 12 is turned off by opening the cover 24 (the position of head 11*a* shown in FIG. 5(C)) and the actual position of the head stopped (the position of the head 11 shown in FIG. 5(C)) is indicated as d in FIG. 5(C). Thus, the position of the head 11 at the time when the excitation is turned off is different from the actual position of the head 11 stopped. The distance d is not a predetermined value and it can vary depending on the circumstances when the cover 24 is opened. Although the rotation of the Y motor 12 is stopped and the head 11 is stopped, the encoder 14 is continuously supplied with power. For that reason, even if the user physically moves the head 11 in the A direction or the opposite direction, the changed rotor position is continuously detected and the detected pulse signal is outputted to the encoder counter 23.

FIG. 6(A) illustrates that the cover 24 is closed after printing is stopped for emergency and the excitation of the Y motor 12 is turned off by opening the cover 24.

When the cover 24 is closed, the switch 25 is turned on by detecting that the cover 24 is closed. Also, the motor control unit 31 of the control device 50 sends a command to supply excitation current to the motor driving circuit 27. The on signal is received by the relay 26 and the relay 26 is turned on. The excitation current which was turned off by the relay 26 is re-supplied from the motor driving circuit 27 to the Y motor 12.

When the excitation current is re-supplied to the Y motor 12, the position determining unit 33 in the control device 50 reads and obtains a count value of the encoder 14 from the encoder counter 23 corresponding to the actual position of the head 11 stopped. The position determining unit 33 determines the current position of the head 11 from the obtained count value. And, the position determining unit 33 calculates the difference between the restart position and the determined actual position of the head 11. The restart position can be predetermined or can be changed by the user, if necessary. According to the present embodiment, the restart position is located on a Y direction scanning line immediate next to the Y direction scanning line on which the head 11 was located when the excitation of the Y motor 12 was turned off. The restart position is the original point (starting point) of the next scanning line. For that reason, the position determining unit 33 reads and obtains count values of the encoders 14 and 15 from the encoder counter 23 at a time when the excitation of the Y motor 12 is turned off by opening the cover 24. From the obtained count values, it determines the position of the head 11 at a time when the excitation is turned off. Based on this position information and conditions of the predetermined restart position, the restart position is determined. The position determining unit 33 calculates the distance between the current position of the head 11 stopped (the position of the head 11 shown in FIG. 6(B)) and the restart position of the head 11 (the position of the head 11*a* shown in FIG. 6(B)).

FIG. 6(C) illustrates that the head 11 is moved to the restart position. The motor controlling unit 31 sends a motor rotation command to the motor driving circuit 27 such that the head 11 is moved by rotating the Y motor 12 and X motor 13 from the current position of the head 11 stopped (the position of head 11*b* shown in FIG. 6(C)) to the restart position (the position of the head 11 shown in FIG. 6(C)) based on the distance determined by the position determining unit 33. The motor driving circuit 27 rotates the Y motor 12 and the X motor 13 according to the command. Thus, the head 11 moves to the restart position.

If the head 11 moves to the restart position, the motor controlling unit 31 of the control device 50 sends a motor rotation command to restart printing to the motor driving circuit 27. The motor driving circuit 27 controls the operation of the Y motor 12 according to the command, and restarts printing by moving the head 11 in the scanning direction (the direction C), as shown in FIG. 6(D).

Because the encoders 14 and 15 in the printer 1 continuously detect the rotor positions after the excitations of the Y motor 12 and the X motor 13 are turned off, the actual position of the head 11 stopped can be determined. Thus, because the restart position of the head 11 can be determined, the desired start position of the head 11 can be determined. If the start position is not determined, the ideal restart position cannot be determined.

Furthermore, since the printer 1 is a UV inkjet printer, UV ink is cured immediately after being discharged when the printer 1 is stopped by an emergency stop. As a result, smearing at a position where printing is stopped can be prevented. Thus, a boundary line in restart position when printing is restarted from a stop position becomes invisible.

The degree of smearing of water-based ink largely depends on a drying time and temperature. Accordingly, inconsistency in degrees of smearing occurs between portions where printing is stopped and restarted because the drying conditions for the two portions are inconsistent. Thus, due to the different smearing degrees, there exists a visible boundary line between the two portions and the quality of printing is decreased. Due to this problem, conventional printers are not configured to restart printing from where the heads are stopped due to an emergency stop.

[Work Examples]

It is preferred that the printer 1 prints many same images in a single work in a grid format.

Figure 7:
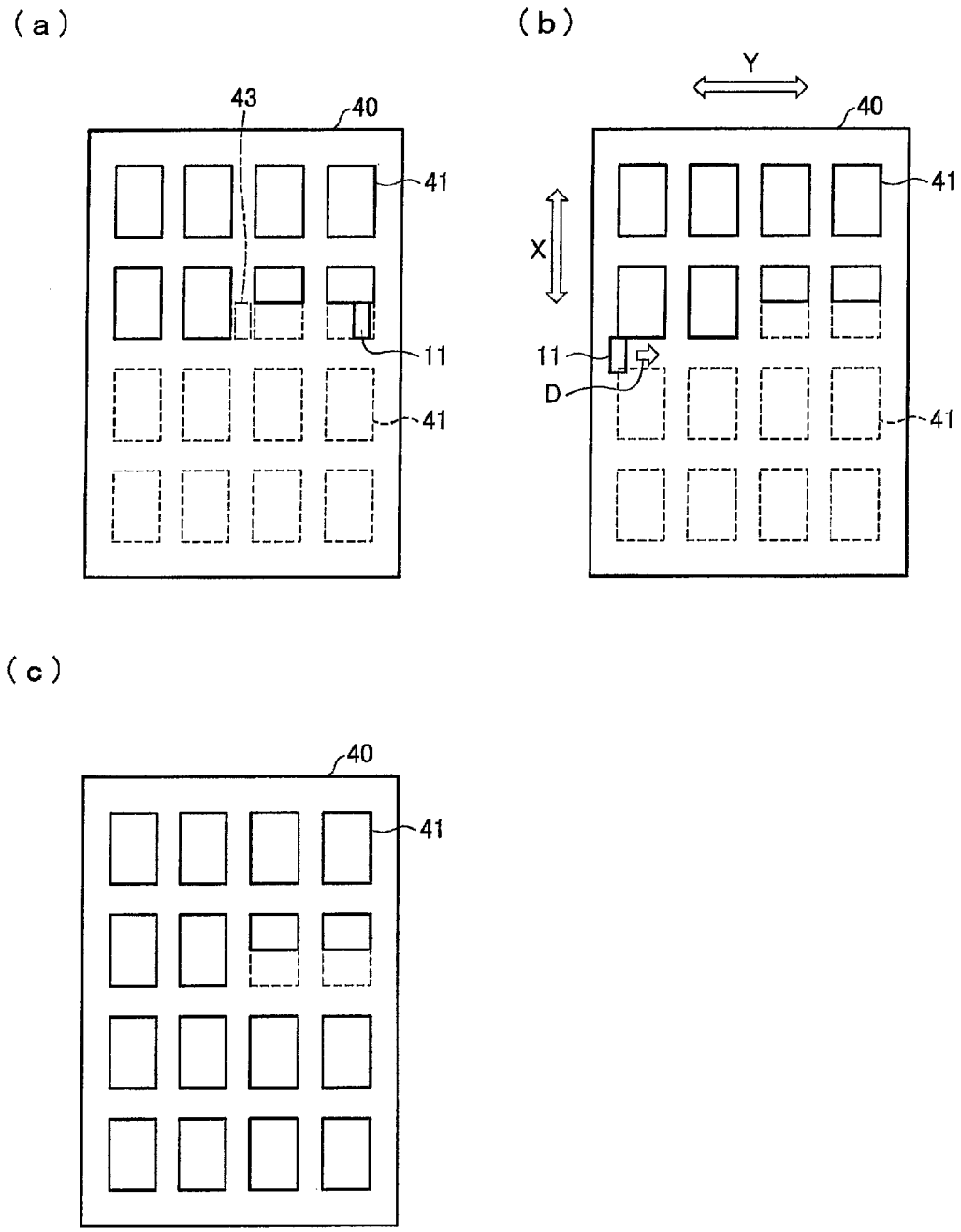
FIGS. 7(A), (B), and (C) illustrate a work and a head according to an embodiment of the present disclosure when an emergency stop occurs.
FIG. 7(B) shows that the head is moved to a restart position for printing.
FIG. 7(C) shows that printing is terminated after the printing.

FIGS. 7(A), (B), and (C) illustrate a work 40 in which same images 41 are printed in a 4 by 4 grid format. The head 11 is shown with the work 40 in FIGS. 7(A) and (B). Areas of the images 41 indicated by the solid line in FIGS. 7(A), (B), and (C) are the part that is already printed and areas indicated by the dotted lines are the part that is not yet printed.

FIG. 7(A) illustrates that the excitation of the motor and printing are stopped by opening the cover during printing while the second row of the images 41 is printed (when the head 11 is in a position 43). Because the head continuously moves for a short moment due to inertia after the excitation is stopped, the head 11 is stopped at a position different from the position 43 when the emergency stop is executed.

FIG. 7(B) illustrates that the head 11 is moved to a restart position from the actual position shown in FIG. 7(A). The printing starts from the restart position after the excitation of the rotor is turned on due to the closed cover. According to the present embodiment, the restart position is located on a Y direction scanning line immediate next to the Y direction scanning line on which the head 11 is located on the position 43 shown in FIG. 7(A). The restart position is the original point (start point) of the next scanning line. Then, printing is restarted by moving the head 11 in the D direction as shown in FIG. 7(B). As a result, as shown in FIG. 7(C), although the images 41 in the third and the fourth columns of the second row are not completed, the rest of the images 41 can be completely printed.

Although there is a portion that is not printed on the work, the restart position can be set in the manner described above for the following cases: (i) when all data do not have to be printed exactly, (ii) when the head 11 stops while returning to the original point of a scanning line in the Y direction after printing on the scanning line is completed, and (iii) when a portion that is not printed is so minimal such that a user can allow. An example of the case (i) includes a case in which, when multiple same images such as the images shown in FIGS. 7(A), (B), and (C) are printed, it is sufficient to have a portion of the work (the first row, up to the middle of the second row, and the third row and thereafter shown in FIGS. 7(A), (B), and (C)) that is properly printed although other portions of the work are not completely printed. In the case (ii), although the print restart position of the head 11 is different from its stop position, there is no portion on the work that is not printed.

Embodiment 2

Another embodiment of the present disclosure will now be explained with reference to FIGS. 8(A) and (B). For convenience of explanation, elements having the same functions as the ones in the embodiment described above use the same reference numbers and the explanation for the same elements are omitted.

In the previous embodiment, the restart position is located on a Y direction scanning line immediate next to the Y direction scanning line on which the head 11 was located when the excitation of the Y motor 12 was turned off. The restart position is the original point (starting point) of the next scanning line.

According to the present embodiment, the restart position is determined to be the position of the head 11 at a time when printing is stopped after the excitation of the motor is stopped.

It is preferred that the printer 1 according to the present embodiment further includes a linear encoder managing printing by the head 11 and the position of the printing.

In the printer 1 according to the present embodiment, the rotor position of the Y motor 12 detected by the encoder 14 is corresponded to the position of printing controlled by the linear encoder. Thus, after the excitation of the Y motor 12 is turned off by opening the cover 24 of the printer 1, the encoders 14 and 15 can detect the rotor positions of the motors at a time when printing by the head 11 is stopped.

When the excitation of the Y motor 12 is turned on by the cover 24 closed, the position determining unit 33 of the control device 50 obtains a count value of the encoder 14 from the encoder counter corresponding to the current stop position of the head 11, and determines the current position of the head 11 from the obtained count values.

Also, the position determining unit 33 obtains from the print controlling unit 32 the stop position of the head 11 and reads and obtains from the encoder counter 23 a count value of the encoder 14 at the stop position of the head 11. The position determining unit 33 determines the position of the head 11 at a time when printing by the head 11 is stopped from the obtained count value. And, the position determining unit 33 calculates the distance between the determined restart position for printing and the determined current position of the head 11. The motor controlling unit 31 of the control device 50 generates a motor rotation command to the motor driving circuit 27 to move the head 11 from the current position to the restart position by rotating the Y motor 12 and the X motor 13. The motor driving circuit 27 rotates the Y motor 12 and the X motor 13 according to the command. Thus, the head 11 is moved to the restart position.

When the head 11 is moved to the restart position, the motor controlling unit 31 of the control device 50 sends a motor rotation command to restart printing to the motor driving circuit 27. The motor driving circuit 27 controls the operation of the Y motor 12 according to the command, and restarts printing by moving the head 11 in the printing direction (the D direction shown in the figures).

In the printer 1, the position of the head 11 is controlled and the detected rotor position of the Y motor 12 is corresponded to the position of the head 11. Thus, when the excitation of the Y motor 12 is turned off and printing is stopped by an emergency stop, the position of the head 11 at a time when printing is stopped can be determined. Accordingly, when restarting to print, the head 11 is moved to the position where printing is stopped. As a result, higher quality printing can be achieved.

The operation of the printer 1 according to the present embodiment can be applied to a case where the entire portion of a single work is printed.

Figure 8:
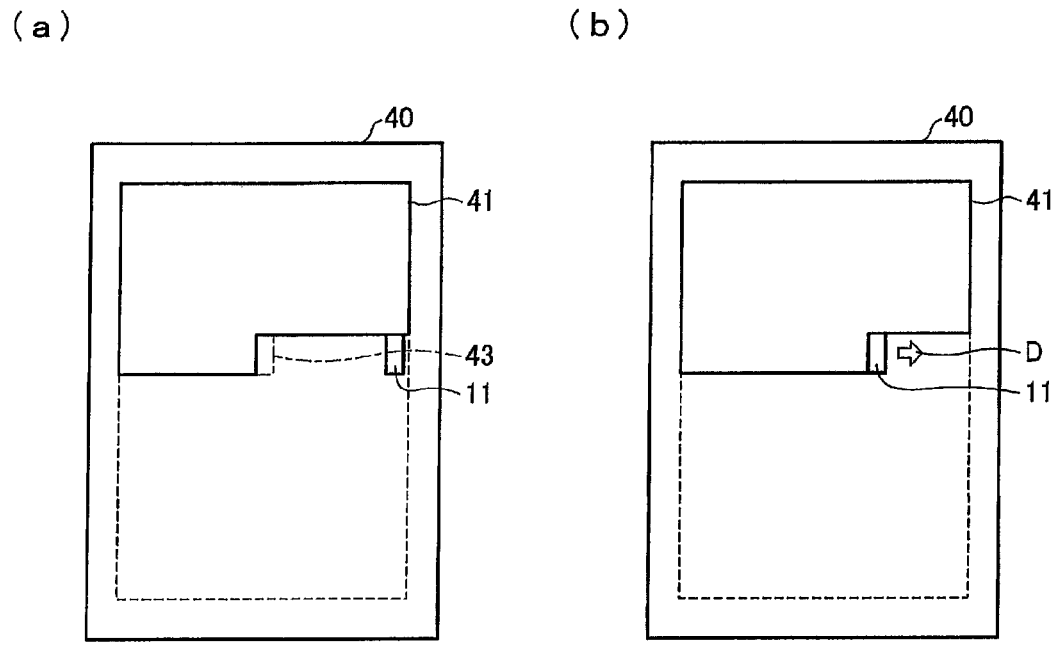

FIGS. 8(A) and (B) illustrates that an emergency stop is executed during printing on the entire portion of the work 40. The head 11 is shown on the work 40 in FIG. 8(A). In FIGS. 8(A) and (B), a portion of the images 41 indicated in solid lines is the portion that printing is completed, and a portion of the images 41 in dotted lines is the portion in which printing is not completed.

FIG. 8(A) illustrates that an emergency stop is executed and the excitation of the motor is turned off when the cover 24 is opened during printing. FIG. 8(A) further illustrates that the head 11 is moved to a position 43. Because the head 11 continues to move for a short moment due to inertia despite the fact that the excitation of the motor is stopped, the actual current position of the head 11 is different from the position 43 at a time when printing is stopped by the emergency stop.

FIG. (B) illustrates that the head 11 is moved to the restart position from the actual current head position shown in FIG.

8(A). According to the present embodiment, the restart position after the excitation of the rotor is turned on by the cover 24 closed is the position at the time when printing is stopped by the emergency stop. After the head 11 is moved to the restart position (the position at the time when printing is stopped), the head 11 restarts to print as the head 11 is moved in the D direction. As a result, all the remaining data to be printed can be completely printed.

[Program and Recording Medium]

The motor controlling unit 31, the print controlling unit 32 and the position determining unit 33 of the control device 50 can be implemented by using a computer as an example. The control device 50 can include a storage device such as a memory storing various programs that enable the computer to function as the motor controlling unit 31, the print controlling unit 32 and the position determining unit 33.

Many printers include a rotary encoder to determine the position of a recording head. Thus, the printer 1 can be implemented by installing the program in the various types of printers.

The purpose of the present disclosure is to provide the recording medium recording the computer-readable program codes to the recording device 50 and to enable the control device to read and execute the program codes.

Examples of the recording medium can be tapes such as magnetic tapes and cassette tapes, magnetic disks such as floppy disks and hard disks, disks including optical disks such as CD-ROM, MO, MD, DVD, and CD-R, cards such as IC cards (including memory cards) and optical cards or semiconductor memories such as mask ROM, EPROM, EEPROM, and flash ROM.

Also, the program code can be supplied to the control device 50 through the control device 50 connected with network communication devices. Such communication networks are not limited to but they can include Internet, Intranet, Extranet, LAN, ISDN, VAN, CATV communication network, virtual private network, telephone line network, mobile communication network, and satellite communication network. Also, transmission media for communication network is not limited but they can use wired communications such as IEEE 1394, USB, power line carrier, cable TV lines, telephone lines, and ADSL lines, wireless communications such as IrDA, infrared rays such as remote controllers, Bluetooth (trademark), 802.11 wireless, HDR, mobile cellular network, satellite cables, and terrestrial digital network. Meanwhile, the computer codes according to the present disclosure can be implemented by electronic transmission and can be realized by computer data signals included in a carrier wave.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An inkjet recording apparatus comprising:

a recording head recording on a recording medium;

a driving motor moving at least one of the recording head and the recording medium in order to change a recording position on the recording medium;

position determining means for determining a position of the recording head relative to the recording medium; and controlling means for controlling the position determining means to continuously determine the position of the recording head relative to the recording medium after an emergency stop command is generated during recordation to turn off excitation of the driving motor, wherein the controlling means controls the position determining means to determine a first position of the recording head relative to the recording medium at a time when a restart command for restarting the recordation is generated after the emergency stop command is generated, wherein after the restart command is generated, the controlling means controls the driving motor to move the recording head in a scanning direction from the determined first position to a second position for restarting the recordation on the recording medium, and controls the recording head and the driving motor to record on the recording medium from the second position by moving the recording head and discharging ink from the recording head, and wherein the controlling means controls the position determining means to determine a third position of the recording head relative to the recording medium at a time when the emergency stop command is generated, the second position being different from the third position.

2. The inkjet recording apparatus of claim 1, wherein the position determining means comprises:

a rotary encoder detecting a rotor position of the driving motor; and an encoder counter counting a signal output from the rotary encoder.

3. The inkjet recording apparatus of claim 2, wherein the controlling means supplies electric power to the rotary encoder and enables the encoder counter to continue counting the signal output from the rotary encoder after the emergency stop command is generated such that the position of the recording head relative to the recording medium is continuously determined by the position determining means.

4. The inkjet recording apparatus of claim 1, wherein the first position of the recording head is a position resulting from an uncontrolled movement of the recording head, which occurs after the emergency stop command is generated.

5. The inkjet recording apparatus of claim 4, wherein the uncontrolled movement is a movement of the recording head which is not controlled by the controlling means.

6. The inkjet recording apparatus of claim 4, wherein the driving motor further rotates by inertia after the emergency stop command is generated, and the uncontrolled movement of the recording head occurs by a further rotation of the driving motor due to the inertia after the emergency stop command is generated.

7. The inkjet recording apparatus of claim 4, wherein the uncontrolled movement of the recording head occurs when a user physically moves the recording head after the emergency stop command is generated.

8. The inkjet recording apparatus of claim 1, wherein the first position of the recording head is a position where the recording head is actually stopped after the emergency stop command is generated.

9. The inkjet recording apparatus of claim 1, wherein the first position of the recording head is different from a position of the recording head at the time when the emergency stop command is generated.

10. The inkjet recording apparatus of claim 1, wherein the controlling means calculates the distance between the first position and the second position to move the recording head from the first position to the second position based on the calculated distance.

11. The inkjet recording apparatus of claim 1, wherein the second position of the recording head is different from the first position.

12. The inkjet recording apparatus of claim 1, wherein the recording head comprises:

a nozzle to discharge UV ink on the recording medium; and an ink curing means mounted near to a back of the nozzle in a scanning direction of the recording head, the ink curing means curing the discharged UV ink by irradiating UV immediately after being discharged on the recording media.

13. The inkjet recording apparatus of claim 1, further comprising a flat printing table on which the flat recording medium is placed to be recorded.

14. The inkjet recording apparatus of claim 13, wherein the recording head is configured to move in both of horizontal and vertical directions with regard to the flat printing table, while the flat printing table and the flat recording medium are not moving.

15. The inkjet recording apparatus of claim 1, wherein the second position is a start position of a scanning line immediate next to a scanning line on which the recording head is located at the time when the emergency stop command is generated.

* * * * *